US012690723B2

(12) United States Patent
Omeally

(10) Patent No.: US 12,690,723 B2
(45) Date of Patent: Jul. 28, 2026

(54) MODULAR SHOWER CADDY DEVICE

(71) Applicant: Neville Omeally, Conyers, GA (US)

(72) Inventor: Neville Omeally, Conyers, GA (US)

( * ) Notice: Subject to any disclaimer, the term of this patent is extended or adjusted under 35 U.S.C. 154(b) by 107 days.

(21) Appl. No.: 18/925,258

(22) Filed: Oct. 24, 2024

(65) Prior Publication Data

US 2025/0151958 A1 May 15, 2025

Related U.S. Application Data

(60) Provisional application No. 63/629,643, filed on Nov. 15, 2023.

(51) Int. Cl.
*A47K 3/28* (2006.01)
*E03C 1/04* (2006.01)

(52) U.S. Cl.
CPC ..... *A47K 3/281* (2013.01); *A47K 3/283* (2013.01); *E03C 1/0408* (2013.01)

(58) Field of Classification Search
CPC ..... A47K 3/281; A47K 3/283; E03C 1/0408; E03C 1/0409
See application file for complete search history.

(56) References Cited

U.S. PATENT DOCUMENTS

| | | | | |
|---|---|---|---|---|
| 5,678,258 | A * | 10/1997 | Healy | E03C 1/0408 4/601 |
| 8,070,074 | B2 * | 12/2011 | Craig | B01F 25/316 239/432 |
| 8,702,018 | B1 * | 4/2014 | Rivera | E03C 1/046 239/311 |
| 9,549,611 | B1 | 1/2017 | Bocanegra | |
| 9,554,673 | B2 | 1/2017 | Panzella | |
| 9,883,742 | B2 | 2/2018 | Yang | |
| 11,185,875 | B2 * | 11/2021 | Koehler | B05B 7/2443 |
| 2006/0242758 | A1 * | 11/2006 | Hall | E03C 1/0408 4/601 |
| 2006/0261022 | A1 | 11/2006 | Sampaio | |
| 2010/0178399 | A1 | 7/2010 | Square | |
| 2023/0089024 | A1 * | 3/2023 | Lin | E03C 1/0408 222/145.6 |

* cited by examiner

*Primary Examiner* — Janie M Loeppke

(57) ABSTRACT

A modular shower caddy device includes a plurality of wall couplers which is each attachable to a wall of the shower. A first basket is coupled to and extends between respective wall couplers and a second basket is coupled to and extends between respective wall couplers to contain and organize personal care items. A support conduit is fluid communication with a water source to receive water. The support conduit is insertable into a slot in each wall coupler of the plurality of wall couplers for mounting the support conduit to the wall of the shower. A first shower head is in communication with the water source to and a second shower head is in fluid communication with the support conduit to receive the water from the support conduit to spray the water onto the user when the user is standing in the shower.

18 Claims, 6 Drawing Sheets

MODULAR SHOWER CADDY DEVICE

CROSS-REFERENCE TO RELATED APPLICATIONS

I hereby claim the benefit under 35 U.S.C. Section 119(e) of U.S. Provisional application 63/629,643, filed on Nov. 15, 2023.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to shower caddy devices and more particularly pertains to a new shower caddy device for storing and organizing personal care items in a shower. The device includes a plurality of wall couplers that is each attachable to a wall of a shower and a pair of baskets, each attached to respective wall couplers for mounting the pair of baskets to the wall of the shower. The device includes a support conduit that is in fluid communication with a water source and the support conduit is positioned in a slot in each of the plurality of wall couplers for mounting the support conduit to the wall of the shower. The device includes a first shower head attached to the water source and a second shower head attached to a hose which is in fluid communication with the support conduit. The plurality of wall couplers inhibit the pair of baskets from tipping over when the second shower head is employed for bathing thereby keeping the personal care items from falling onto a floor of the shower.

(2) Description of Related Art Including Information Disclosed Under 37 CFR 1.97 and 1.98

The prior art relates to shower caddy devices including: a shower caddy device that is a unitary structure including a plurality of baskets and a central support; a towel shower caddy device including a box for storing towels and a basket suspended beneath the box and a hanger extending upwardly from the box for suspending the box from a shower head; a shower shelving device comprising a central support member and a clasp attached to the central support member which releasably engages a shower head and a plurality of baskets each attached to the central support member and a plurality of wall couplers attached to the central support member which each engage a wall in a shower; a shower caddy device which includes a screw and a hook attached to the screw for suspending the screw from a shower head and a plurality of funnels each threadably attached to the screw which can be rotated to move the funnels upwardly or downwardly along the screw. In no instance does the prior art disclose a modular shower caddy that includes a plurality of wall couplers that are attachable to a wall in a shower and a pair of baskets each attached to respective wall couplers and a support conduit that is positionable in a slot in each of the wall couplers to mount the support conduit to the wall in the shower and a first shower head attached to a water pipe of the shower and a second shower head that includes a hose that is attached to the support conduit.

BRIEF SUMMARY OF THE INVENTION

An embodiment of the disclosure meets the needs presented above by generally comprising a plurality of wall couplers which is each attachable to a wall of the shower. A first basket is coupled to and extends between respective wall couplers and a second basket is coupled to and extends between respective wall couplers to contain and organize personal care items. A support conduit is fluid communication with a water source to receive water. The support conduit is insertable into a slot in each wall coupler of the plurality of wall couplers for mounting the support conduit to the wall of the shower. A first shower head is in communication with the water source to and a second shower head is in fluid communication with the support conduit to receive the water from the support conduit to spray the water onto the user when the user is standing in the shower.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
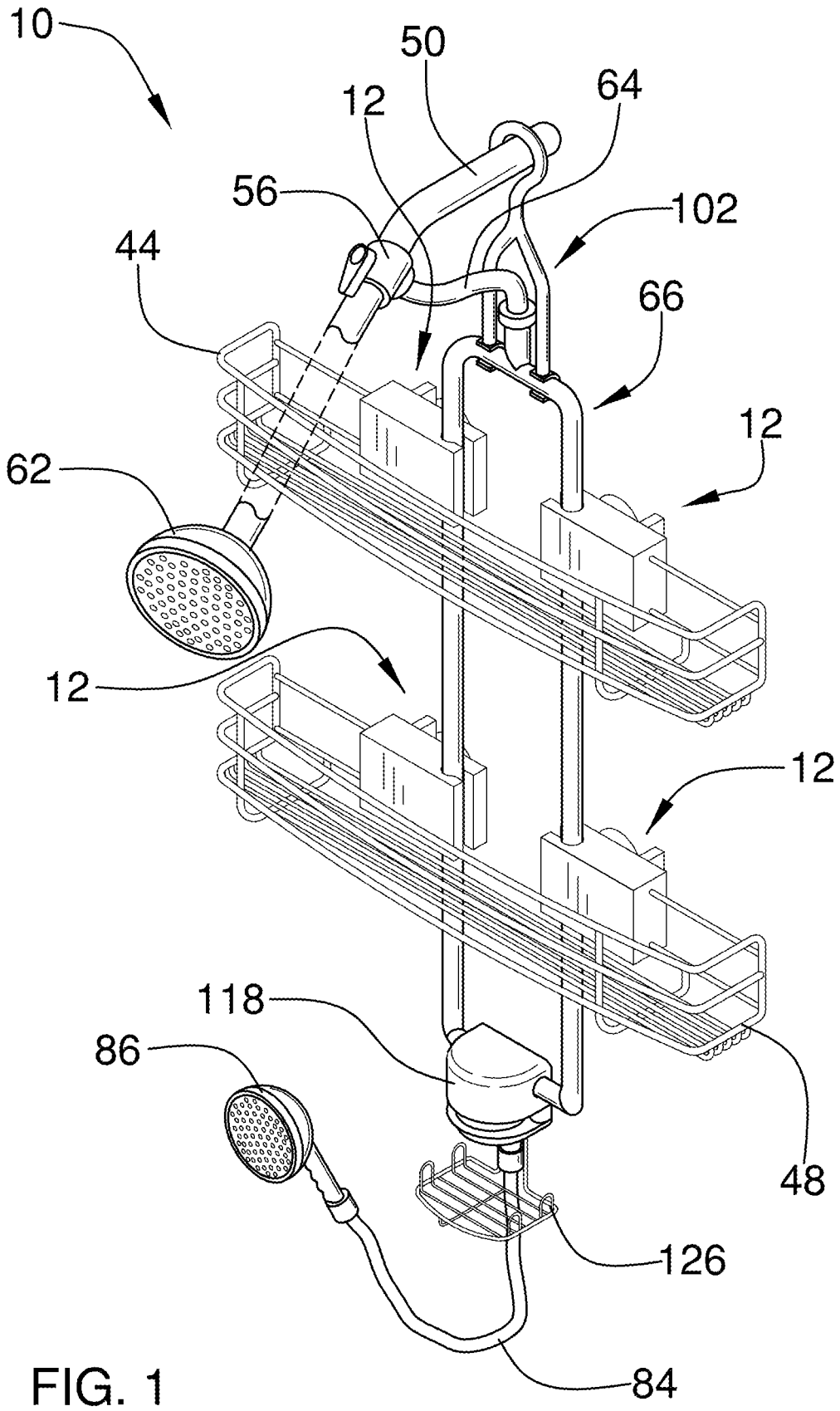
FIG. 1 is a perspective view of a modular shower caddy device according to an embodiment of the disclosure.

With reference now to the drawings, and in particular to FIGS. 1 through 12 thereof, a new shower caddy device embodying the principles and concepts of an embodiment of the disclosure and generally designated by the reference numeral 10 will be described.

As best illustrated in FIGS. 1 through 6, the modular shower caddy device 12 generally comprises a plurality of wall couplers 12 each being attachable to a wall 14 of a shower 16. The shower 16 might be a walk in shower or a tub/shower combo or any other type of shower that a user 18 would employ for bathing. Each wall coupler 12 of the plurality of wall couplers 12 has a respective slot 20 extending through a respective wall coupler 12. The respective slot 20 in each wall coupler 12 extends into a first lateral side 22 of the respective wall coupler 12 toward a second lateral side 24 of the respective wall coupler 12 and the respective slot 20 extends through each of a top side 26 and a bottom side 28 of the respective wall coupler 12. The respective slot 20 in each wall coupler 12 of the plurality of wall couplers 12 has a first bounding surface 30 and a second bounding surface 32 each being perpendicular to the first lateral side 22 of a respective wall coupler 12. Furthermore, the respective slot 20 in each wall coupler 12 of the plurality of wall couplers 12 has a rear bounding surface 34 which is continuously concave between the first bounding surface 30 and the second bounding surface 32; the rear bounding surface 34 defines a circular portion 36 of the slot 20 which has a diameter that is greater than a width of a space between the first bounding surface 30 and the second bounding surface 32. Additionally, the plurality of wall couplers 12 includes a first pair of wall couplers 38 and a second pair of wall couplers 40.

A plurality of suction cups 42 is provided and each suction cup 42 of the plurality of suction cups 42 has a coupled end 39 which is coupled to a back side 41 of a respective wall coupler 12 of the plurality of wall couplers 12. Each suction cup 42 of the plurality of suction cups 42 flares between the coupled end 39 and a free end 43 of a respective suction cup 42. Additionally, each suction cup 42 of the plurality of suction cups 42 is comprised of a deformable material, including but not being limited to rubber or silicone, thereby enabling each suction cup 42 to suctionally engage the wall 14 of the shower 16 when each suction cup 42 is compressed against the wall 14 of the shower 16. As is most clearly shown in FIG. 9, each wall coupler 12 of the plurality of wall couplers 12 includes a support wall 45 that extends away from the back side 41 of a respective wall coupler 12 and which extends between the top side 26 and the bottom side 28 of the respective wall coupler 12. The support wall 45 associated with the respective wall coupler 12 is positioned next to the suction cup 42 on the back side 41 of the respective wall coupler 12. Furthermore, the support wall 45 on the respective wall coupler 12 abuts the wall 14 of the shower 16 to inhibit the respective wall coupler 12 from tilting at an angle with respect to the wall 14 of the shower 16 thereby retaining the back side 41 of the respective wall coupler 12 in a parallel orientation with the wall 14 of the shower 16.

A first basket 44 is coupled to and extends between each of the first pair of wall couplers 38 to contain and organize personal care items 46 when the first pair of wall couplers 38 is attached to the wall 14 of the shower 16. The personal care items 46 might include a bottle of shampoo and a bottle of conditioner and a bottle of body wash or any other type of personal item that the user 18 might employ while bathing in the shower 16. A second basket 48 is coupled to and extends between each of the second pair of wall couplers 40 to contain and organize personal care items 46 when the second pair of wall couplers 40 is attached to the wall 14 of the shower 16.

A feed conduit 50 is provided which is in fluid communication with a water source 52 in the shower 16 thereby enabling the feed conduit 50 to receive water 54 from the water source 52. The water source 52 may be a water pipe that services the shower 16. A valve 56 is provided and the valve 56 is fluidly integrated into the feed conduit 50. The valve 56 is manipulatable into a closed condition to enable the water 54 to flow through the feed conduit 50 while inhibiting the water 54 from flowing through an output 58 of the valve 56. Conversely, the valve 56 is manipulatable into an open condition to inhibit the water 54 from flowing through the feed conduit 50 while enabling the water 54 to flow through the output 58 of the valve 56. The valve 56 may be a two position fluid valve of any conventional design such as a ball valve, for example and the valve may include a lever 60 that can be gripped by the user 18 to manipulating the valve 56 between the open condition and the closed condition. Additionally, the feed conduit 50 may comprise a rigid pipe or other type of inflexible conduit.

Figure 2:
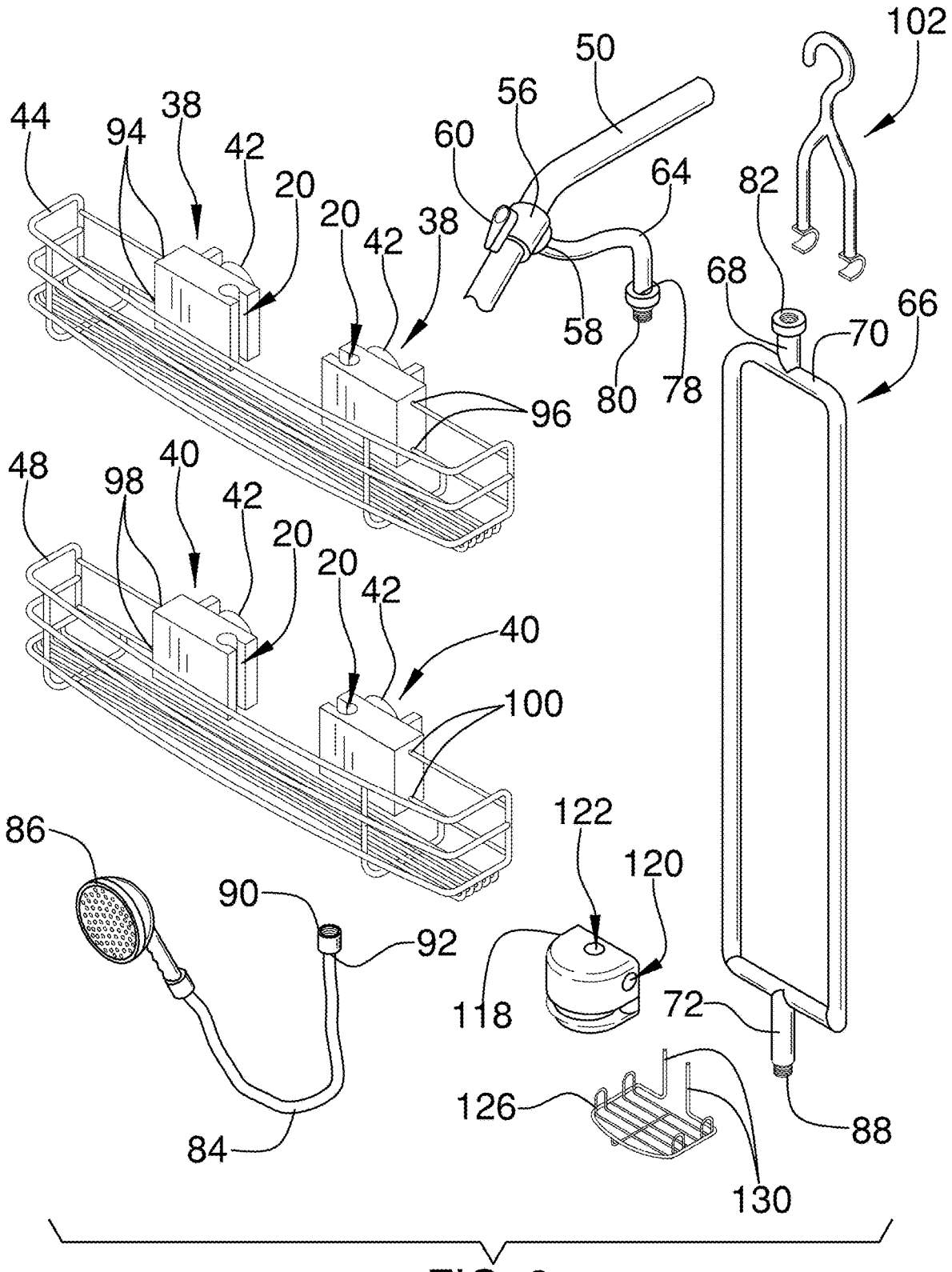
FIG. 2 is an exploded perspective view of an embodiment of the disclosure.
Figure 3:
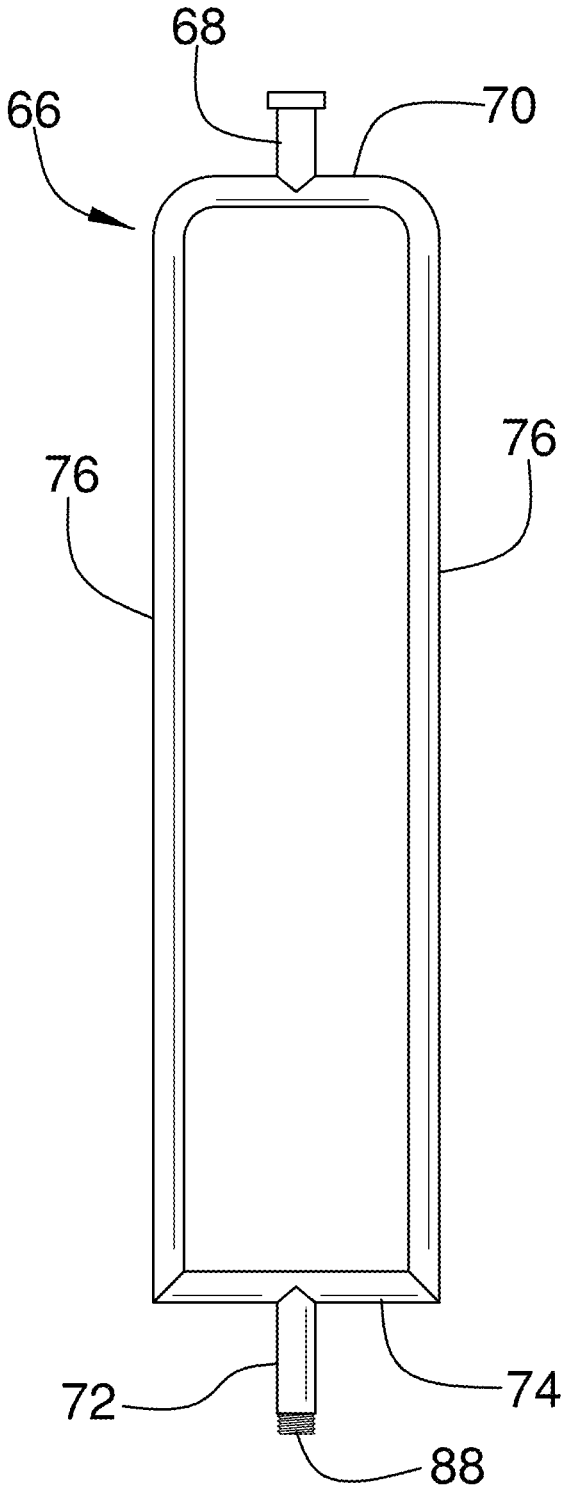
FIG. 3 is a front view of a support conduit of an embodiment of the disclosure.
Figure 4:
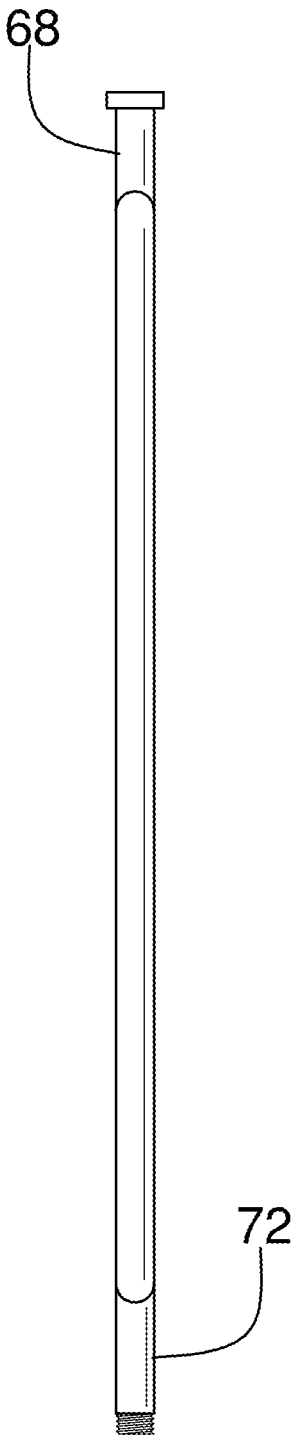
FIG. 4 is a right side view of a support conduit of an embodiment of the disclosure.
Figure 5:
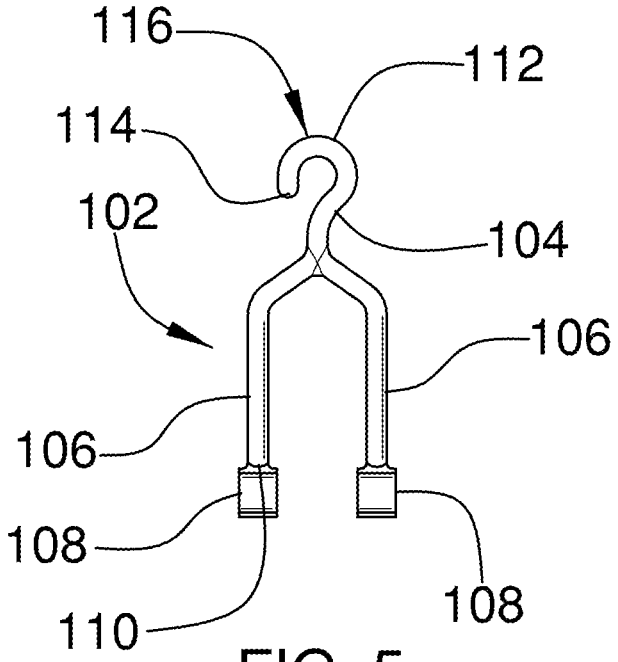
FIG. 5 is a front view of a hanger of an embodiment of the disclosure.
Figure 6:
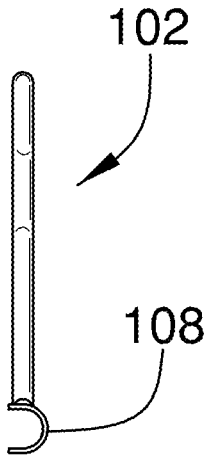
FIG. 6 is a left side view of a hanger of an embodiment of the disclosure.
Figure 7:
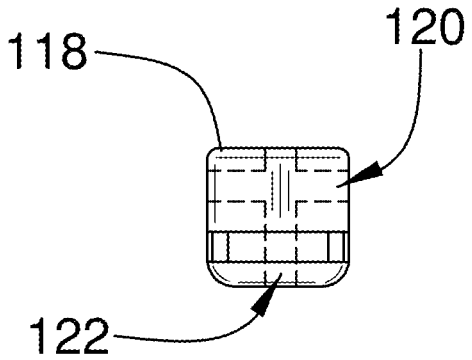
FIG. 7 is a top view of a cover of an embodiment of the disclosure.
Figure 8:
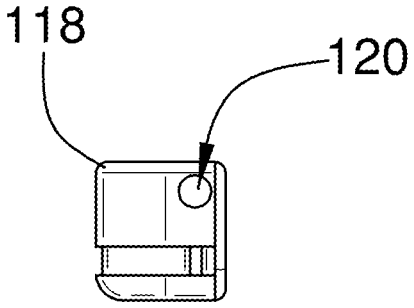
FIG. 8 is a left side view of a cover of an embodiment of the disclosure.
Figure 9:
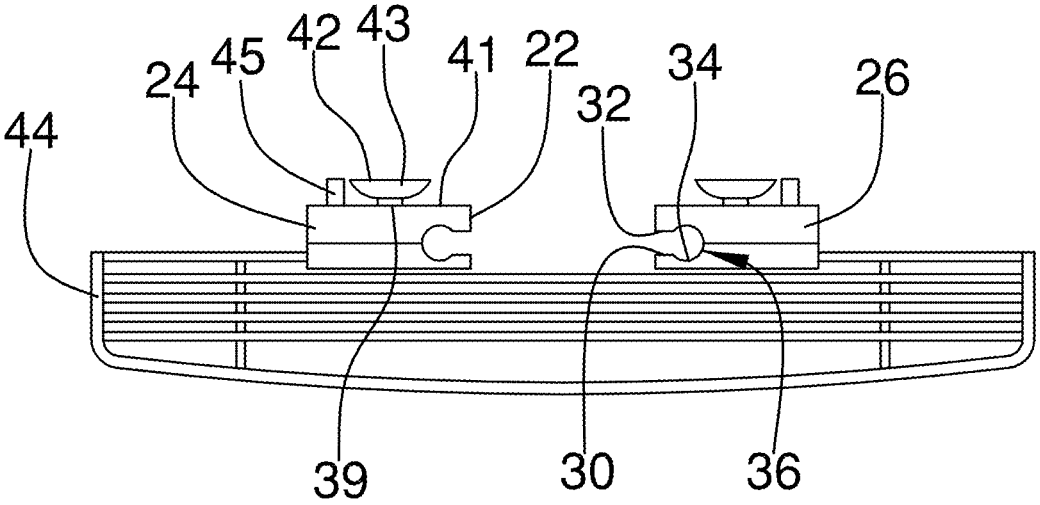
FIG. 9 is a top view of a first pair of wall couplers and a first basket of an embodiment of the disclosure.
Figure 10:
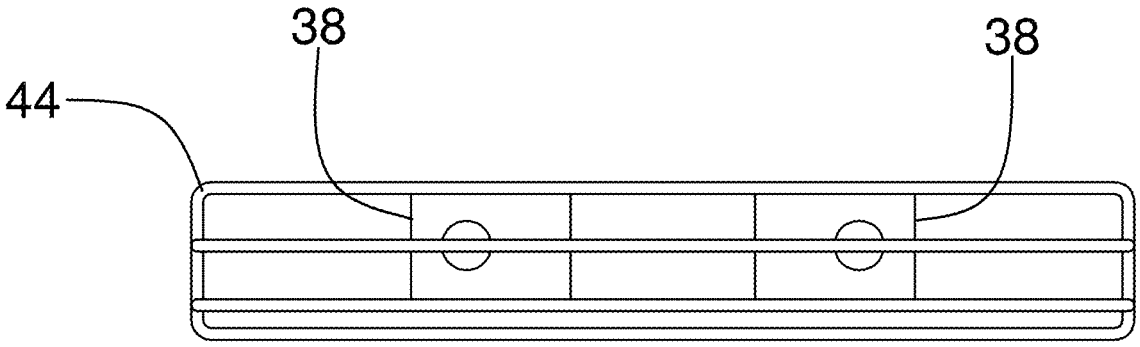
FIG. 10 is a front view of a first pair of wall couplers and a first basket of an embodiment of the disclosure.
Figure 11:
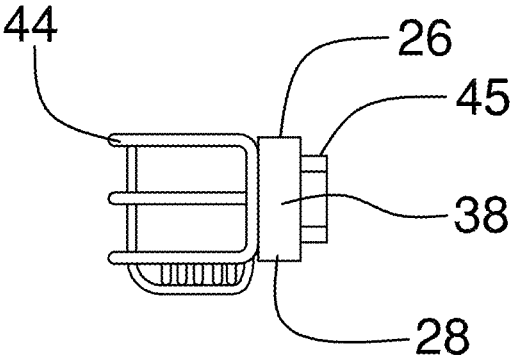
FIG. 11 is a left side view of a first pair of wall couplers and a first basket of an embodiment of the disclosure.
Figure 12:
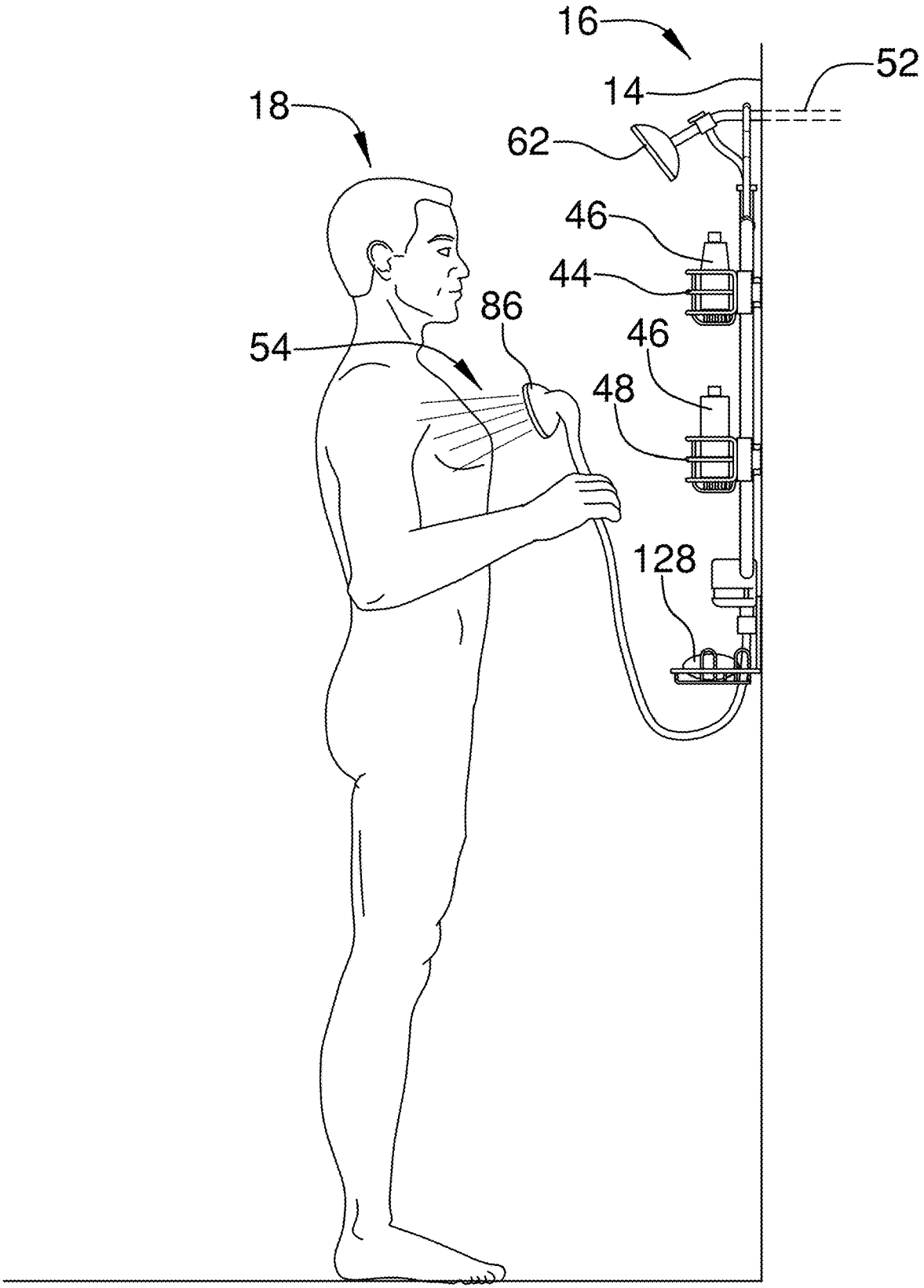
FIG. 12 is a perspective in-use view of an embodiment of the disclosure.

A first shower head 62 is coupled to the feed conduit 50 to receive the water 54 from the feed conduit 50 when the valve 56 is manipulated into the closed condition. The first shower head 62 sprays the water 54 into a user 18 when the user 18 is standing in the shower 16 and when the valve 56 is manipulated into the closed condition. A supply conduit 64 is coupled to the output 58 of the valve 56 to receive the water 54 from the output 58 of the valve 56 when the valve 56 is manipulated into the open condition. A support conduit 66 is provided which has an input pipe 68 that is perpendicular to a top pipe 70 and an output pipe 72 that is perpendicular to a bottom pipe 74 and a pair of outer pipes 76 each extending between the top pipe 70 and the bottom pipe 74. An intersection between each outer pipe 76 of the pair of outer pipes 76 and the top pipe 70 is curved; an intersection between each outer pipe 76 of the pair of outer pipes 76 and the bottom pipe 74 defines a right angle. The input pipe 68 is coupled to a distal end 78 of the supply conduit 64 with respect to the output 58 of the valve 56 thereby enabling the input pipe 68 to receive the water 54 from the supply conduit 64 when the valve 56 is manipulated into the open condition. As is shown in FIG. 2, the supply conduit 64 may include a threaded coupler 80 disposed on the distal end 78 of the supply conduit 64 which threadably engages a threaded receiver 82 on the input pipe 68.

An output conduit 84 is coupled to the output pipe 72 of the support conduit 66 to receive the water 54 from the output pipe 72 when the valve 56 is manipulated into the open condition. A second shower head 86 is coupled to the output conduit 84 and the second shower head 86 can be gripped by the user 18 to enable the user 18 to direct the second shower head 86 toward themselves when the user 18 is standing in the shower 16. The second shower head 86 is in fluid communication with the output conduit 84 to receive the water 54 from the output conduit 84 when the valve 56 is manipulated into the open condition thereby enabling the second shower head 86 to spray the water 54 onto the user 18 when the user 18 is standing in the shower 16. The output conduit 84 may comprise a flexible water hose or other type of flexible conduit. As is shown in FIG. 2, the output pipe 72 may be threaded adjacent to a bottom end 88 of the output pipe 72 and the output conduit 84 may include a threaded receiver 90 that is disposed on a first end 92 of the output conduit 84 which threadably engages the output pipe 72.

The first basket 44 has a first end 94 which is coupled to the second lateral side 24 of a respective one of the first pair of wall couplers 38 and a second end 96 that is coupled to the second lateral side 24 of a respective one of the first pair of wall couplers 38. The first pair of wall couplers 38 is spaced apart from each other having the first lateral side 22 of the first pair of wall couplers 38 being directed toward each other. Furthermore, each outer pipe 76 of the pair of outer pipes 76 of the support conduit 66 can be inserted into the respective slot 20 in a respective one of the first pair of wall couplers 38 until each outer pipe 76 of the pair of outer pipes 76 is seated in the circular portion 36 of the respective slot 20 in the respective first wall coupler 12. The first basket 44 curves forwardly from each of the first pair of wall couplers 38 such that the first basket 44 extends laterally away from the wall 14 of the shower 16 when the first pair of wall couplers 38 is attached to the wall 14 of the shower 16.

The second basket 48 has a first end 98 which is coupled to the first lateral side 22 of a respective one of the second pair of wall couplers 40 and a second end 100 which is coupled to the second lateral side 24 of a respective one of the second pair of wall couplers 40. The second pair of wall couplers 40 is spaced apart from each other having the first lateral side 22 of the second pair of couplers being directed toward each other. Furthermore, each outer pipe 76 of the pair of outer pipes 76 of the support conduit 66 can be inserted into the respective slot 20 in a respective one of the second pair of couplers until each outer pipe 76 of the pair of outer pipes 76 is seated in the circular portion 36 of the respective slot 20 in the respective second wall coupler 12. The second basket 48 curves forwardly from each of the second pair of wall couplers 40 such that the second basket 48 extend laterally away from the wall 14 of the shower 16 when the second pair of wall couplers 40 is attached to the wall 14 of the shower 16 having the second basket 48 being located beneath the first basket 44. Additionally, a respective second wall coupler 40 of the pair the second pair of wall couplers 40 which is located on a respective outer pipe 76 of the pair of outer pipes 76 is positioned beneath a respective first wall coupler 38 of the first pair of wall couplers 38 that is located the respective outer pipe 76.

A hanger 102 is provided and the hanger 102 is removably attachable to the top pipe 70 of the support conduit 66. The hanger 102 is extendable over the feed conduit 50 thereby enabling the feed conduit 50 to support the weight of the personal care items 46 in the first basket 44 and the second basket 48. Furthermore, the hanger 102 inhibits the supply conduit 64 from being exposed to the weight of the personal care items 46 in the first basket 44 and the second basket 48. The hanger 102 has a medial member 104 extending away from a pair of arms 106 having the pair of arms 106 being oriented parallel to each other. The hanger 102 has a pair of couplers 108 which is each attached to a bottom end 110 of a respective arm 106 of the pair of arms 106. Each coupler 108 of the pair of couplers 108 is curved to enable each coupler 108 of the pair of couplers 108 to extend around the top pipe 70 of the support conduit 66 having each arm 106 of the pair of arms 106 extending upwardly from the top pipe 70. The medial member 104 has a curve 112 which extends from a free end 114 of the medial member 104 toward the pair of arms 106 to define a hook 116 which extends around the feed conduit 50.

A cover 118 is positioned around the bottom pipe 74 of the support conduit 66 and the output pipe 72 of the support conduit 66 having the output pipe 72 extending downwardly from the cover 118. The cover 118 has a first hole 120 extending laterally through the cover 118 and the bottom pipe 74 extends through the first hole 120 such that the cover 118 is positioned beneath the second basket 48. The cover 118 has a second hole 122 extending between a bottom side 124 of the cover 118 and the first hole 120 and the output pipe 72 of the support conduit 66 extends through the second hole 122. A third basket 126 is coupled to and is positioned beneath the cover 118 having the third basket 126 being oriented to lie on a horizontal plane for supporting a bar of soap 128. The third basket 126 has a pair of support members 130 each coupled to and extending downwardly from the bottom side 28 of the cover 118 having the second hole 122 in the bottom side 28 of the cover 118 being located between the pair of support members 130.

In use, the hook of the hanger 102 is positioned over the feed conduit 50 to support the support conduit 66 on the wall 14 of the shower 16 and each of the plurality of wall couplers 12 is attached to the wall 14 of the shower 16 to stabilize each of the first basket 44 and the second basket 48 on the wall 14 of the shower 16. The personal care items 46 can be stored and organized in the first basket 44 and the second basket 48 and the plurality of wall couplers 12 inhibits the first basket 44 and the second basket 48 from tipping and spilling the personal care items 46. The valve 56 is manipulated into the closed condition to direct the water 54 to the first shower head 62 thereby enabling the first shower head 62 to be employed for bathing. Conversely, the valve 56 is manipulated into the open position to direct the water 54 to the second shower head 86 thereby enabling the second shower head 86 to be employed for bathing. The hanger 102 and the plurality of wall couplers 12 enables the second shower head 86 to be employed without dislodging the first basket 44 or the second basket 48 from the wall 14 and spilling the personal care items 46.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A modular shower caddy device for organizing personal care items in a shower, said device comprising:

a plurality of wall couplers each being configured to attach to a wall of the shower, each wall coupler of said plurality of wall couplers has a respective slot extending through a respective wall coupler;

wherein said plurality of wall couplers includes a first pair of wall couplers and a second pair of wall couplers;

a first basket being coupled to and extending between each of said first pair of wall couplers wherein said first basket is configured to contain and organize the personal care items when said first pair of wall couplers is attached to the wall of the shower;

a second basket being coupled to and extending between each of said second pair of wall couplers wherein said second basket is configured to contain and organize the personal care items when said second pair of wall couplers is attached to the wall of the shower;

a feed conduit being configured to be in fluid communication with a water source in the shower thereby enabling said feed conduit to receive water from the water source;

a valve being fluidly integrated into said feed conduit, said valve being manipulatable into a closed condition wherein said valve is configured to enable the water to flow through said feed conduit while inhibiting the water from flowing through an output of said valve, said valve being manipulatable into an open condition wherein said valve is configured to inhibit the water from flowing through said feed conduit while enabling the water to flow through said output of said valve;

a first shower head being coupled to said feed conduit wherein said first shower head is configured to receive the water from the feed conduit when said valve is manipulated into said closed condition thereby enabling said first shower head to spray the water into a user when the user is standing in the shower;

a supply conduit being coupled to said output of said valve wherein said supply conduit is configured to receive the water from said output of said valve when said valve is manipulated into said open condition;

a support conduit having an input pipe being coupled to a distal end of said supply conduit with respect to said output of said valve wherein said input pipe is configured to receive the water from said supply conduit when said valve is manipulated into said open condition, said support conduit being insertable into said respective slot in each wall coupler of said plurality of wall couplers wherein said support conduit is configured to be mounted to the wall of the shower;

an output conduit being coupled to said output pipe of said support conduit wherein said output conduit is configured to receive the water from said output pipe when said valve is manipulated into said open condition;

a second shower head being coupled to said output conduit wherein said second shower head is configured to be gripped by a user to enable the user to direct said second shower head toward themselves when the user is standing in the shower, said second shower head being in fluid communication with said output conduit wherein said second shower head is configured to receive the water from said output conduit when said valve is manipulated into said open condition thereby enabling said second shower head to spray the water onto the user when the user is standing in the shower;

a hanger being removably attachable to said top pipe of said support conduit, said hanger being extendable over said feed conduit wherein said feed conduit is configured to support the weight of the personal care items in said first basket and said second basket thereby inhibiting said supply conduit from being exposed to the weight of the personal care objects in said first basket and said second basket;

a cover being positioned around said bottom pipe of said support conduit and said output pipe of said support conduit having said output pipe extending downwardly from said cover; and a third basket being coupled to and being positioned beneath said cover having said third basket being oriented to lie on a horizontal plane wherein said third basket is configured to support a bar of soap.

2. The modular shower caddy device according to claim 1, wherein said respective slot in a respective wall coupler of said plurality of wall couplers extends into a first lateral side of said respective wall coupler toward a second lateral side of said respective wall coupler.

3. The modular shower caddy device according to claim 2, wherein said respective slot extends through each of a top side and a bottom side of said respective wall coupler.

4. The modular shower caddy device according to claim 2, wherein said respective slot in each wall coupler of said plurality of wall couplers has a first bounding surface and a second bounding surface each being perpendicular to said first lateral side of a respective wall coupler.

5. The modular shower caddy device according to claim 4, wherein said respective slot in each wall coupler of said plurality of wall couplers has a rear bounding surface being continuously concave between said first bounding surface and said second bounding surface such that said rear bounding surface defines a circular portion of said respective slot which has a diameter being greater than a width of a space between said first bounding surface and said second bounding surface.

6. The modular shower caddy device according to claim 5, wherein:

said support conduit has a pair of outer pipes each extending between a top pipe and a bottom pipe; and said first basket has a first end being coupled to said second lateral side of a respective one of said first pair of wall couplers and a second end being coupled to said second lateral side of a respective one of said first pair of wall couplers such that said first pair of wall couplers is spaced apart from each other having said first lateral side of said first pair of wall couplers being directed toward each other thereby enabling each outer pipe of said pair of outer pipes of said support conduit to be inserted into said respective slot in a respective one of said first pair of wall couplers until each outer pipe of said pair of outer pipes is seated in said circular portion of said respective slot in said respective first wall coupler.

7. The modular shower caddy device according to claim 5, wherein:

said support conduit has a pair of outer pipes each extending between a top pipe and a bottom pipe; and said second basket has a first end being coupled to said first lateral side of a respective one of said second pair of wall couplers and a second end being coupled to said second lateral side of a respective one of said second pair of wall couplers such that said second pair of wall couplers is spaced apart from each other having said first lateral side of said second pair of couplers being directed toward each other thereby enabling each outer pipe of said pair of outer pipes of said support conduit to be inserted into said respective slot in a respective one of said second pair of couplers until each outer pipe of said pair of outer pipes is seated in said circular portion of said respective slot in said respective second wall coupler.

8. The modular shower caddy device according to claim 7, wherein a respective second wall coupler of said pair said second pair of wall couplers which is located on a respective outer pipe of said pair of outer pipes is positioned beneath a respective first wall coupler of said first pair of wall that is located said respective outer pipe.

9. The modular shower caddy device according to claim 1, wherein said hanger has a medial member extending away from a pair of arms having said pair of arms being oriented parallel to each other.

10. The modular shower caddy device according to claim 9, wherein said hanger has a pair of couplers each being attached to a bottom end of a respective arm of said pair of arms.

11. The modular shower caddy device according to claim 10, wherein each coupler of said pair of couplers is curved to enable each coupler of said pair of couplers to extend around a top pipe of said support conduit having each arm of said pair of arms extending upwardly from said top pipe.

12. The modular shower caddy device according to claim 9, wherein said medial member has a curve extending from a free end of said medial member toward said pair of arms to define a hook which extends around said feed conduit.

13. The modular shower caddy device according to claim 8, wherein:

said cover has a first hole extending laterally through said cover; and said bottom pipe extends through said first hole such that said cover is positioned beneath said second basket.

14. The modular shower caddy device according to claim 13, wherein:

said cover has a second hole extending between a bottom side of said cover and said first hole; and said output pipe of said support conduit extends through said second hole.

15. The modular shower caddy device according to claim 14, wherein said third basket has a pair of support members each being coupled to and extending downwardly from said bottom side of said cover having said second hole in said bottom side of said cover being located between said pair of support members.

16. The modular shower caddy device according to claim 1, wherein:

said device includes a plurality of suction cups; and each suction cup of said plurality of suction cups has a coupled end being coupled to a back side of a respective wall coupler of said plurality of wall couplers.

17. The modular shower caddy device according to claim 16, wherein:

each suction cup of said plurality of suction cups flares between said coupled end and a free end of a respective suction cup; and each suction cup of said plurality of suction cups is comprised of a deformable material wherein each suction cup is configured to suctionally engage the wall of the shower when each suction cup is compressed against the wall of the shower.

18. A modular shower caddy device for organizing personal care items in a shower, said device comprising:

a plurality of wall couplers each being configured to attach to a wall of the shower, each wall coupler of said plurality of wall couplers having a respective slot extending through a respective wall coupler, said respective slot extending into a first lateral side of said respective wall coupler toward a second lateral side of said respective wall coupler, said respective slot extending through each of a top side and a bottom side of said respective wall coupler, said respective slot in each wall coupler of said plurality of wall couplers having a first bounding surface and a second bounding surface each being perpendicular to said first lateral side of a respective wall coupler, said respective slot in each wall coupler of said plurality of wall couplers having a rear bounding surface being continuously concave between said first bounding surface and said second bounding surface such that said rear bounding surface defines a circular portion of said respective slot which has a diameter being greater than a width of a space between said first bounding surface and said second bounding surface;

wherein said plurality of wall couplers includes a first pair of wall couplers and a second pair of wall couplers;

a plurality of suction cups, each suction cup of said plurality of suction cups having a coupled end being coupled to a back side of a respective wall coupler of said plurality of wall couplers, each suction cup of said plurality of suction cups flaring between said coupled end and a free end of a respective suction cup, each suction cup of said plurality of suction cups being comprised of a deformable material wherein each suction cup is configured to suctionally engage the wall of the shower when each suction cup is compressed against the wall of the shower;

a first basket being coupled to and extending between each of said first pair of wall couplers wherein said first basket is configured to contain and organize the personal care items when said first pair of wall couplers is attached to the wall of the shower;

a second basket being coupled to and extending between each of said second pair of wall couplers wherein said second basket is configured to contain and organize the personal care items when said second pair of wall couplers is attached to the wall of the shower;

a feed conduit being configured to be in fluid communication with a water source in the shower thereby enabling said feed conduit to receive water from the water source;

a valve being fluidly integrated into said feed conduit, said valve being manipulatable into a closed condition wherein said valve is configured to enable the water to flow through said feed conduit while inhibiting the water from flowing through an output of said valve, said valve being manipulatable into an open condition wherein said valve is configured to inhibit the water from flowing through said feed conduit while enabling the water to flow through said output of said valve;

a first shower head being coupled to said feed conduit wherein said first shower head is configured to receive the water from the feed conduit when said valve is manipulated into said closed condition thereby enabling said first shower head to spray the water into a user when the user is standing in the shower;

a supply conduit being coupled to said output of said valve wherein said supply conduit is configured to receive the water from said output of said valve when said valve is manipulated into said open condition;

a support conduit having an input pipe being perpendicular to a top pipe, said support conduit having an output pipe being perpendicular to a bottom pipe, said support conduit having a pair of outer pipes each extending between said top pipe and said bottom pipe, an intersection between each outer pipe of said pair of outer pipes and said top pipe being curved, an intersection between each outer pipe of said pair of outer pipes and said bottom pipe defining a right angle, said input pipe being coupled to a distal end of said supply conduit with respect to said output of said valve wherein said input pipe is configured to receive the water from said supply conduit when said valve is manipulated into said open condition;

an output conduit being coupled to said output pipe of said support conduit wherein said output conduit is configured to receive the water from said output pipe when said valve is manipulated into said open condition;

a second shower head being coupled to said output conduit wherein said second shower head is configured to be gripped by a user to enable the user to direct said second shower head toward themselves when the user is standing in the shower, said second shower head being in fluid communication with said output conduit wherein said second shower head is configured to receive the water from said output conduit when said valve is manipulated into said open condition thereby enabling said second shower head to spray the water onto the user when the user is standing in the shower;

said first basket having a first end being coupled to said second lateral side of a respective one of said first pair of wall couplers and a second end being coupled to said second lateral side of a respective one of said first pair of wall couplers such that said first pair of wall couplers is spaced apart from each other having said first lateral side of said first pair of wall couplers being directed toward each other thereby enabling each outer pipe of said pair of outer pipes of said support conduit to be inserted into said respective slot in a respective one of said first pair of wall couplers until each outer pipe of said pair of outer pipes is seated in said circular portion of said respective slot in said respective first wall coupler, said first basket curving forwardly from each of said first pair of wall couplers wherein said first basket is configured to extend laterally away from the wall of the shower when said first pair of wall couplers is attached to the wall of the shower;

said second basket having a first end being coupled to said first lateral side of a respective one of said second pair of wall couplers and a second end being coupled to said second lateral side of a respective one of said second pair of wall couplers such that said second pair of wall couplers is spaced apart from each other having said first lateral side of said second pair of couplers being directed toward each other thereby enabling each outer pipe of said pair of outer pipes of said support conduit to be inserted into said respective slot in a respective one of said second pair of couplers until each outer pipe of said pair of outer pipes is seated in said circular portion of said respective slot in said respective second wall coupler, said second basket curving forwardly from each of said second pair of wall couplers wherein said second basket is configured to extend laterally away from the wall of the shower when said second pair of wall couplers is attached to the wall of the shower having said second basket being located beneath said first basket;

wherein a respective second wall coupler of said pair said second pair of wall couplers which is located on a respective outer pipe of said pair of outer pipes is positioned beneath a respective first wall coupler of said first pair of wall that is located said respective outer pipe;

a hanger being removably attachable to said top pipe of said support conduit, said hanger being extendable over said feed conduit wherein said feed conduit is configured to support the weight of the personal care items in said first basket and said second basket thereby inhibiting said supply conduit from being exposed to the weight of the personal care objects in said first basket and said second basket, said hanger having a medial member extending away from a pair of arms having said pair of arms being oriented parallel to each other, said hanger having a pair of couplers each being attached to a bottom end of a respective arm of said pair of arms, each coupler of said pair of couplers being curved to enable each coupler of said pair of couplers to extend around said top pipe of said support conduit having each arm of said pair of arms extending upwardly from said top pipe, said medial member having a curve extending from a free end of said medial member toward said pair of arms to define a hook which extends around said feed conduit;

a cover being positioned around said bottom pipe of said support conduit and said output pipe of said support conduit having said output pipe extending downwardly from said cover, said cover having a first hole extending laterally through said cover, said bottom pipe extending through said first hole such that said cover is positioned beneath said second basket, said cover having a second hole extending between a bottom side of said cover and said first hole, said output pipe of said support conduit extending through said second hole; and a third basket being coupled to and being positioned beneath said cover having said third basket being oriented to lie on a horizontal plane wherein said third basket is configured to support a bar of soap, said third basket having a pair of support members each being coupled to and extending downwardly from said bottom side of said cover having said second hole in said bottom side of said cover being located between said pair of support members.

* * * * *